United States Patent [19]

Parrish, Jr.

[11] 3,980,237

[45] Sept. 14, 1976

[54] DIFFERENTIAL VALVE IN FUEL INJECTION NOZZLE

[75] Inventor: Walter A. Parrish, Jr., Hazel Crest, Ill.

[73] Assignee: Allis-Chalmers Corporation, Milwaukee, Wis.

[22] Filed: Nov. 17, 1975

[21] Appl. No.: 632,854

[52] U.S. Cl. ..... 239/533; 239/584

[51] Int. Cl.[2] ..... F02M 61/04; B05B 1/30

[58] Field of Search ..... 239/533, 5, 91, 96, 239/569, 570, 583, 584, 585

[56] References Cited

UNITED STATES PATENTS

| | | | |
|---|---|---|---|
| 2,927,737 | 3/1960 | Zeuch et al. | 239/533 |
| 3,391,871 | 7/1968 | Fleischer et al. | 239/584 X |
| 3,836,080 | 9/1974 | Butterfield et al. | 239/533 X |

FOREIGN PATENTS OR APPLICATIONS

| | | | |
|---|---|---|---|
| 906,603 | 9/1962 | United Kingdom | 239/533 |

*Primary Examiner*—Robert S. Ward, Jr.
*Attorney, Agent, or Firm*—Arthur L. Nelson

[57] ABSTRACT

A double cone differential valve in a fuel injection nozzle having a smaller included angular difference between the valve body and the valve needle above the seat seal than the included angular difference between the valve body and the valve needle below the valve seat seal to prolong the preset opening pressure of the differential valve.

10 Claims, 5 Drawing Figures

PRIOR ART

DIFFERENTIAL VALVE IN FUEL INJECTION NOZZLE

This invention relates to a fuel injection nozzle and more particularly to a valve in the fuel injection nozzle having a double coned surface at the valve and a single cone surface at the mating valve seat in the nozzle body with a smaller differential angle between the valve and seat above the valve seat seal than the differential angle between the valve and the seat below the valve seat seal to assure that the effective seat seal of the valve will progress upwardly instead of downwardly and tend to maintain the original valve opening pressure of the fuel injection nozzle.

The differential valve is normally biased to a closed position by a spring and is opened in response to the fluid pressure from the fuel injection pump applied in the fuel injection nozzle to lift the valve against the spring force when the pressure in the fuel injection nozzle reaches a predetermined level. As the valve seat wears down, the spring becomes extended due to valve wear and the spring force is reduced with a consequent loss of valve opening pressure.

The differential angle between the valve and body coned surfaces is used to assure a firm seating of the valve in the closed position. Conventional valves of this type are constructed with a larger included angular difference between the cone surface of the valve body and the valve above the seat than the included angular difference between the cone surface of the valve body and the valve below the seat. Carbon deposits which form below this seat line in the area of the smaller differential angle tend to build up and cause the effective valve seat to move downwardly from the initial seat line. This will cause more area above the seat line to be exposed to incoming pressure from the pump. Since the area under pressure is increased and the spring load remains essentially constant, the valve opening pressure will decrease. If the opening and thus the closing pressure of the valve is reduced too much, combustion gases can more easily enter the nozzle and cause rapid damage and increased carbon buildup.

Accordingly it is an object of this invention to provide for a differential angle coned valve in which the line joining the coned surfaces forms the initial seat against the valve seat in the mating body element. The various coned surfaces may be formed on either the valve or the nozzle body although it is preferred to form a single cone surface in the nozzle body and the double coned surface on the valve. This is preferred since it is easier to machine the outside surfaces of the valve than it is to machine the inside surfaces of the valve body.

It is an object of this invention to provide a double coned differential angle valve seat in a fuel injection nozzle.

It is a further object of this invention to provide a nozzle assembly having a double cone valve for seating on a single cone valve body for maintaining a predetermined initial valve seat diameter or larger than the initial valve seat diameter to maintain the valve opening pressure.

It is a further object of this invention to provide a nozzle assembly having a double cone surface on the valve body for engaging a single cone surface on the valve for maintaining a predetermined effective valve seat diameter or larger for maintaining the opening pressure above a predetermined minimum.

It is a further object of this invention to provide a double cone differential valve with the differential angle between the valve and valve body above the seat at a smaller value than the differential angle below the valve seat to assure valve opening pressures above the predetermined minimum.

It is a further object of this invention to provide a double cone differential angle valve with a smaller differential angle between the surface of the valve body and a surface of the valve above the valve seat than the differential angle between the valve body and the valve below the valve seat to cause the effective seat of the valve to move upwardly instead of downwardly due to wear between the valve and body which will tend to increase the diameter of the valve seat seal and maintain opening and closing pressures of the differential valve at or above a predetermined value.

The objects of this invention are accomplished by providing a nozzle assembly having a double cone surface on one of the elements of the nozzle assembly consisting of the valve body and the valve and a single cone surface on the other of the elements consisting of the valve body and the valve. A peripheral line adjoining the differential cone surfaces defines the seat of the valve. The differential angle between the upper cone surfaces and the mating cone surface above the valve seat is a smaller angle than the differential angle between the lower cone surface and the mating cone surface below the valve seat. Accordingly, due to wear of the seat of the differential valve, the seat will tend to migrate upward and produce an effectively larger diameter valve seat because of wear. This upward seat migration and resulting larger seat diameter reduces the valve surface exposed to pressure above the seat line and tends to increase the pressure required to open the valve. Thus it will compensate for the loss in spring force due to wear between the two elements. This assures operation of the valve at or above predetermined opening pressure. Carbon deposits forming in the area below the seat line will not tend to change the effective seat since the differential angle between the valve body and the valve below the valve seat is sufficiently large to delay or forestall this effect.

Referring to the drawings, the preferred embodiments of this invention are illustrated.

Figure 1:
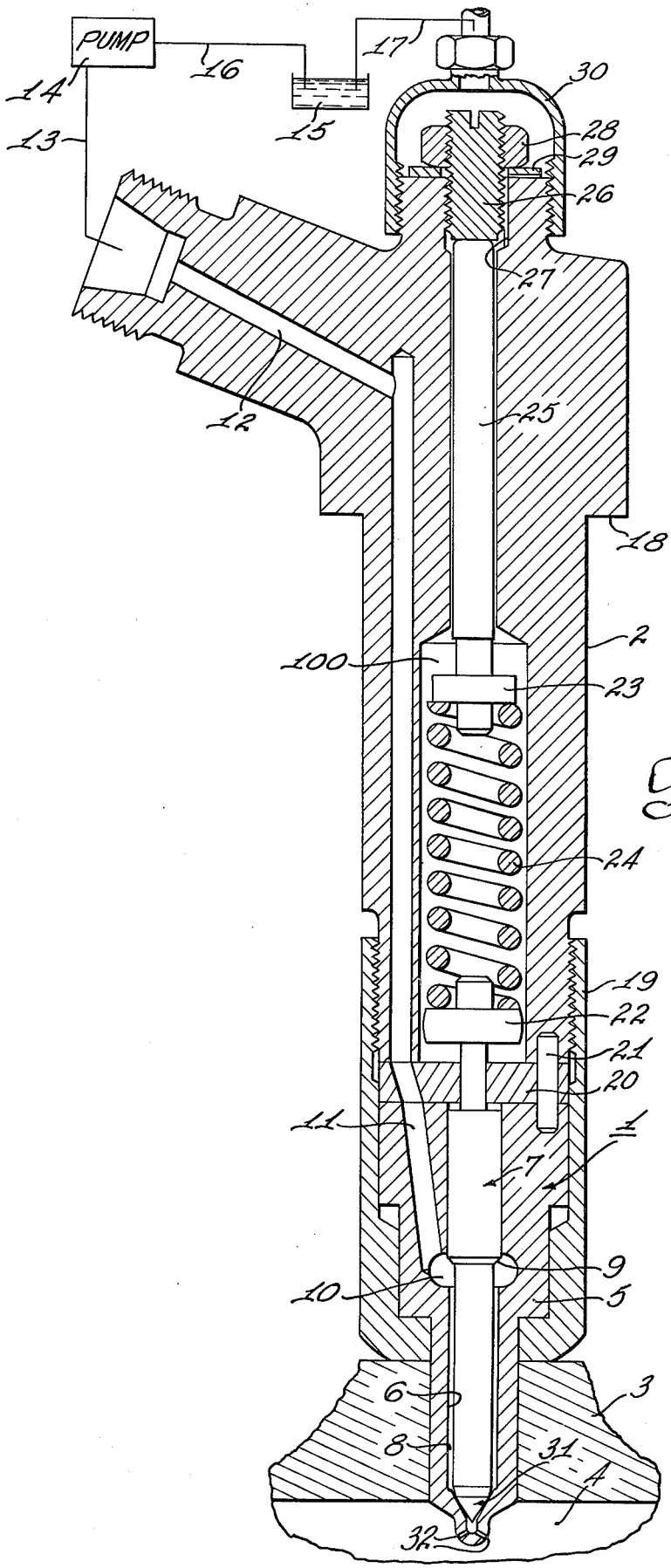
FIG. 1 illustrates an assembly for a nozzle and holder assembly including a nozzle assembly.

Referring to the drawings, the fuel injection nozzle assembly 1 is fastened to the nozzle holder 2 by the threaded cap 19. The nozzle 1 is mounted on an internal combustion engine 3 for injection of fuel into the combustion chamber 4. The fuel injection nozzle assembly includes the nozzle body 5 defining a central opening 6 for receiving the valve needle 7. The central opening 6 forms the valve chamber 8 which receives pressurized fluid from the fuel injection pump. The valve 7 is formed with a shoulder 9 in chamber 10. The chamber 10 is in communication with the passage 11 which extends upwardly through the holder 2 to the inlet passage 12. The inlet passage 12 is connected to the conduit 13 from the fuel injection pump 14. The fuel injection pump is driven by the engine 3 to provide timed pressure pulses which are supplied to the fuel injection nozzle. Pump 14 receives fluid from the fuel supply 15 through the conduit 16. The return manifold 17 returns fluid leakage from the fuel injection nozzle 1 to the fuel supply 15.

The nozzle holder 2 is provided with a mounting flange 18 adapted for mounting the nozzle holder on the engine. The cap 19 threadedly engages the periphery of the lower end of the nozzle holder 2 and the spacer 20 together while the dowel pin 21 provides the alignment of the adjoining members.

The valve needle 7 extends upwardly through the spacer and engages the spring seat 22. Similarly, the spring seat 23 engages the upper end of the spring 24 which is compressively positioned between the spring seats 22 and 23. The spindle 25 engages the upper surface of the spring seat 23 and is adjustably positioned by the adjusting screw 26 which threadedly engages a threaded opening 27 in the nozzle holder 2. A lock nut 28 locks the adjusting screw 26 as it is tightened against the washer 29 in the upper end of the nozzle holder. The fitting 30 threadedly engages the external periphery of the nozzle holder 2 and is provided for connection with the return conduit 17 to the supply 15. Clearance is provided between the spindle 25, screw 26, and washer 29 to allow return of nozzle fluid leakage from spring chambr 100.

Accordingly, as the pressure from the fuel injection pump 14 is supplied to the valve chamber 8, the valve 7 lifts from the valve seat when the predetermined pressure is present in the chamber 8. Pressurized fluid flows past the valve cone 31 through the orifice 32 into the combustion chamber.

Figure 2:
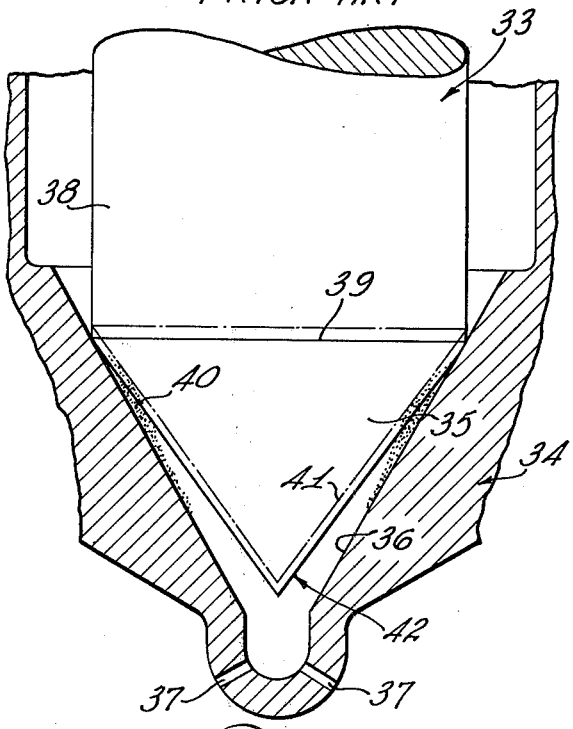
FIG. 2 illustrates a conventional differential valve for a fuel injection nozzle assembly.

Referring to FIG. 2, the valve 33 is shown positioned against the valve body 34. The valve 33 illustrated is a single cone valve having a cone surface 35. The cone surface 35 is of a slightly larger cone angle than the cone surface 36 of the valve body 34. The valve body includes orifices 37 which spray the pressurized fuel into the combustion chamber. It is noted that the larger angled cone of the surface 35 engages the cone surface 36 at the adjoining cylindrical surface 38 and the cone surface 35 to form the initial seat seal 39.

A phantom view shows the valve 33 in a slightly raised position in which carbon deposits 40 engage valve 33. Under these conditions, the effective seat seal of the valve 42 is lowered slightly allowing increased effective area of the pressurized fuel from the fuel injection pump to act on the valve 33. This will cause the fuel injection valve to open at a lower pressure than when the valve is operating at the initial seat seal 39.

Figure 3:
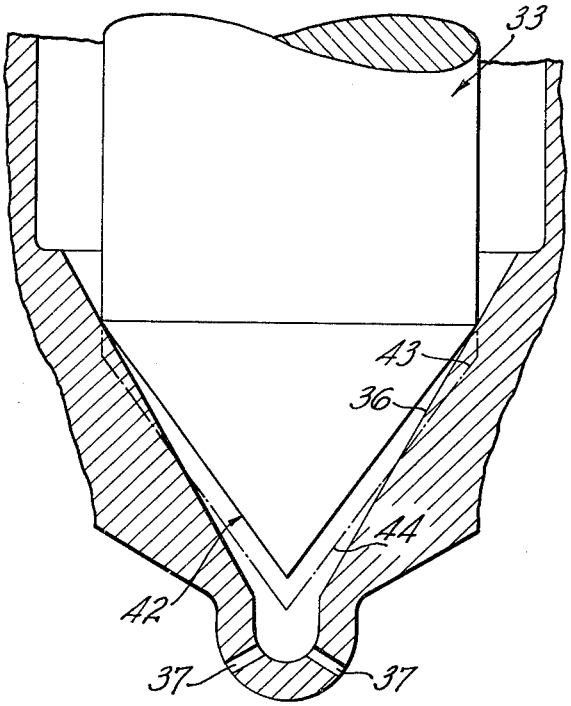
Fig. 3 PRIOR ART
FIG. 3 illustrates a conventional differential valve to a fuel injection nozzle assembly and shows the conditions of wear between the differential valve and the valve body.

FIG. 3 illustrates a similar conventional valve in which the valve 33 has worn a pocket 43 in the valve body surface 36 to allow the valve needle to lower to the position as shown in the phantom view indicated by the cone surface line 44. With a valve needle 33 in the lowered position, the spring force is reduced because the spring has extended, resulting in a lower force on the differential valve needle 33. At the same time, the effective valve seat has migrated downwardly from the initial seat line, increasing the area of the valve exposed to pressure above the seat which also lowers the valve opening pressure. With a lower opening pressure of the differential valve, combustion gases may be allowed to enter through the orifice 37 and cause carbonizing of the fuel and deposits to form on the valve body surface 36.

Figure 4:
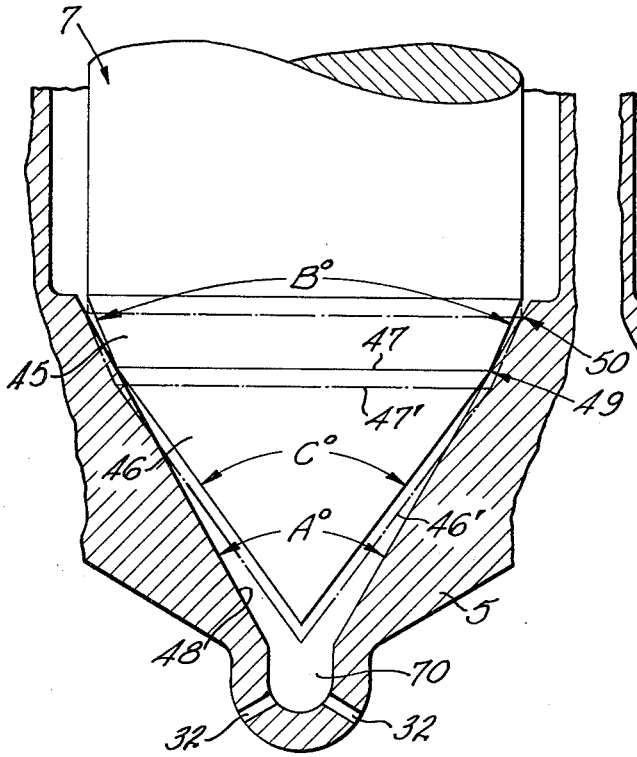
FIG. 4 illustrates the preferred embodiment of a differential valve of this invention.

FIG. 4 illustrates the preferred embodiment of the invention. The valve needle 7 is formed with different cone surfaces 45 and 46. The adjoining peripheral line 47 defines the initial seat of the valve needle 7 with the single cone surface 48 of the valve body 5. Fuel is injected from the nozzle through orifices 32.

The initial seat 49 is defined by the joining peripheral line 47 as it engages the single cone surface 48 of the valve body 5. Due to valve body wear, the valve may drop to a position shown in the phantom view in which a surface line 46' moves to the lowered position of the conical surface 46 and the joining peripheral line 47 is shown at 47'. Although the spring force is reduced in this position, due to the small differential angle between the cone surface 45 of the valve 7 and the cone surface 48 of the valve body 5, the valve seat moves upwardly to the new seat 50 as shown in the phantom view. The seating diameter increases and this offsets the loss of the spring force and tends to maintain original opening pressure. The larger differential angle between the cone surface 46 of the valve 7 and cone surface 48 of seat 5 below the seat line prevents seating of the valve on the valve body and the opening pressures of the differential valve are maintained.

Figure 5:
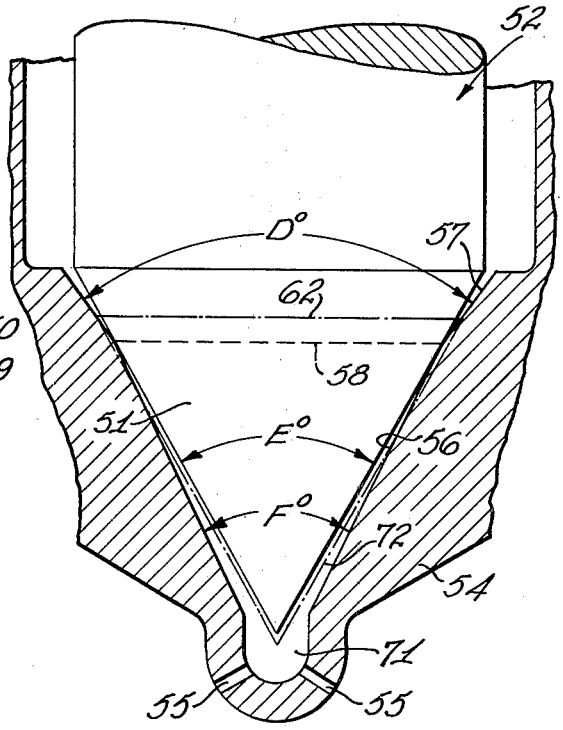
FIG. 5 illustrates a modification of the preferred embodiment of a differential valve illustrating the invention.

FIG. 5 illustrates a modification of the differential valve. The cone surface 51 is a single cone surface on the end of the valve 52. The valve body 54 is formed with orifices 55 for injection of fuel into the combustion chamber. The valve body 54 is formed with a lower cone surface 56 and an upper cone surface 57. The differential angle between angle D of the upper cone surface 57 of the body 54 and the angle E of the cone surface 51 of the needle 52 is essentially the same as differential angle between the angle B of upper cone surface 45 of needle 7 and the angle A of the valve body cone surface 48. The differential angle between the angle E of the cone surface 51 on the needle 52 and the angle F of the lower cone surface 56 of the valve body 54 is essentially the same as the differential angle between the lower cone angle C of the valve 7 and the angle A of the valve body cone surface 48. The operation of the valves are essentially the same and the adjoining peripheral line 58 of the adjoining surface of the lower cone surface 56 and the upper cone surface 57 forms the initial seat seal of the differential valve 52. The valve seat will tend to move upwardly as indicated by the phantom view of the seat line 62 which tends to increase the diameter of the seat seal line of the differential valve 52.

The operation of the differential valve will be described in the following paragraphs.

The differential valve shown in FIG. 4 illustrates the preferred embodiment of this invention. The valve includes a double cone surface valve including the upper cone surface 45 and the lower cone surface 46 with an adjoining peripheral line 47 which defines the initial seat 49 of the valve 7 on the cone surface 48 of valve body 5. Pressurized fluid from the fuel injection pump 14 passes through the inlet passage 12 into the passage 11 and the chambers 10 and 8 to lift the valve needle 7 when the pressure in the valve chambers 8 and 10 reaches a predetermined value. The pressurized fluid acts on the shoulder 9 and the surface 45 to lift the valve needle 7 against the force of the spring 24. The valve remains open so long as the pressure from the pump 14 holds the valve 7 open. When the pressure in the chambers 8 and 10 falls below a predetermined level, the force of the spring 24 overcomes the pressure on the valve 7 and the valve 7 closes.

Due to wear, the valve may drop to a position shown in 47' in which the valve 7 reseats itself on the valve body 5. Due to the smaller differential angle, namely, the differential angle of A minus angle B which is approximately 1/2° and no more than 2°, the effective valve seat tends to migrate upward. This, in turn, causes a greater valve seat diameter as indicated by the seat line 50. Although the spring force is reduced, the smaller effective area exposed to the pressurized fluid on the valve 7 causes the valve to open at a pressure as great as the original opening pressure. Accordingly, this will maintain adequate pressure in the nozzle to prevent combustion gases from coming into the sack chamber 70. This, in turn, will prevent deposition of carbon which may be formed from the fuel in the valve seating area.

Referring to FIG. 5, a modification of the preferred embodiment of this invention is illustrated. The valve 52 due to wear will migrate toward the lowered position as shown in the phantom view 72 and valve seat line 62. Again, because of the smaller differential angle, in other words, the angle D of upper cone surface 57 of the valve body less the angle E of the cone surface on the valve needle 52, which is smaller than the differential angle between the cone angle E of the cone surface 51 and the lower cone surface F of the valve body 54, the effective valve seat will tend to migrate upward. Although the valve 52 moves to a lower position due to wear and the spring force is decreased, the effective seat diameter of the differential valve seat 62 will be increased. The effective area exposed to the high pressure fluid of the differential valve from the fuel injection pump is a smaller area and the effective opening pressure remains essentially the same. This, in turn, maintains a high operating fuel injection pressure which will tend to maintain the sack chamber 71 free of combustion gases. This, in turn, will prevent the hot gases from producing carbon from the fuel and depositing this carbon on the cone surfaces of the valve and also prevent erosion of the valve to prevent failure of the differential valve.

The embodiments of the invention in which an exclusive property or privilege is claimed are defined as follows:

1. A nozzle assembly in a fuel injection nozzle and holder assembly for an internal combustion engine comprising, valve elements including a valve body and a valve defining conical surfaces forming a differential angle valve, resilient means normally biasing said differential angle valve to a closed position with said differential angle valve opening in response to the force of pressurized fluid in said nozzle assembly opposing the biasing force of said resilient means, said nozzle body defining orifices downstream from said differential angle valve, one of said valve elements including intersecting conical surfaces defining a valve seat seal when engaging the other of said elements, said valve body and said valve defining a differential angle valve of smaller differential angle between the cone surface of said valve body and the cone surface of said valve above said valve seat seal than the angle said valve body and said valve define between the cone surface of said valve body and the cone surface of said valve downstream from said valve seat seal, the smaller differential angle between said valve body and said valve upstream from said valve seat seal thereby causing the valve seat seal to migrate upwardly from the initial valve seat seal due to wear of said valve.

2. A nozzle assembly in a fuel injection nozzle and holder assembly for an internal combustion engine as set forth in claim 1 wherein the differential angle between conical surfaces of the elements upstream of the valve seat seal of the nozzle assembly is no greater than two degrees.

3. A nozzle assembly in a fuel injection nozzle and holder assembly for an internal combustion engine as set forth in claim 1 wherein the differential angle between the conical surfaces of the elements in the nozzle assembly below the valve seat seal is no less than two degrees.

4. A nozzle assembly in a fuel injection nozzle and holder assembly for an internal combustion engine as set forth in claim 1 wherein differential conical surfaces are formed on the valve which form an adjoining peripheral line defining the valve seat seal of the nozzle assembly.

5. A nozzle assembly in a fuel injection nozzle and holder assembly for an internal combustion engine as set forth in claim 1 wherein said valve body defines differential conical surfaces in which the adjoining peripheral line formed by said differential conical surfaces defines the valve seat seal of said nozzle assembly.

6. A nozzle assembly in a fuel injection nozzle and holder assembly for an internal combustion engine as set forth in claim 1 wherein one of said elements defines an upper conical surface and a lower conical surface of angles of approximately five degrees difference.

7. A nozzle assembly in a fuel injection nozzle and holder assembly for an internal combustion engine as set forth in claim 1 wherein the upstream conical angle of the double conical surface element defines an angle of within the range of one-half to two degrees difference from the angle of single cone surface element of the nozzle assembly.

8. A nozzle assembly in a fuel injection nozzle and holder assembly for an internal combustion engine as set forth in claim 1 wherein the downstream conical angle of the double conical surface element defines a cone angle within the range of two to six degrees difference from the cone angle of the single conical surface element of the nozzle assembly.

9. A nozzle assembly in a fuel injection nozzle and holder assembly for an internal combustion engine as set forth in claim 1 wherein the seat seal line defined by adjoining conical surfaces of a double conical surface valve element define differential angles between the valve and the valve body such that the valve seat line tends to migrate upstream due to wear and thereby increase the valve seat seal diameter for maintaining an essentially constant operating pressure of the differential valve regardless of reduction in spring force in closing said valve.

10. A nozzle assembly in a fuel injection nozzle and holder assembly for an internal combustion engine as set forth in claim 1 wherein the differential angle between the lower conical surface of a double conical element and a single conical surface of a single conical surface element of said nozzle assembly defines an angle of such a magnitude to not cause interference between said elements nor cause the seat seal line to migrate downstream of the initial seat seal because of wear of the valve or deposition of foreign material on the valve conical surfaces.

* * * * *